US007040692B1

(12) United States Patent
Pine

(10) Patent No.: US 7,040,692 B1
(45) Date of Patent: May 9, 2006

(54) SUPPORT MECHANISM FOR ROCKER-RECLINER CHAIR

(75) Inventor: James J. Pine, Tupelo, MS (US)

(73) Assignee: JPD, Inc., Tupelo, MS (US)

( * ) Notice: Subject to any disclaimer, the term of this patent is extended or adjusted under 35 U.S.C. 154(b) by 0 days.

(21) Appl. No.: 10/986,782

(22) Filed: Nov. 15, 2004

(51) Int. Cl.
*A47C 1/02* (2006.01)

(52) U.S. Cl. ..... 297/85; 297/DIG. 7; 297/270.2

(58) Field of Classification Search ..... 297/DIG. 7, 297/85, 259.2, 270.1, 270.2
See application file for complete search history.

(56) References Cited

U.S. PATENT DOCUMENTS 3,243,226 A * 3/1966 Katz ..... 297/85
3,322,459 A * 5/1967 Hampton ..... 297/85
3,622,198 A * 11/1971 Re ..... 297/94
4,601,513 A * 7/1986 Pine ..... 297/269.1
4,707,025 A 11/1987 Rogers
5,971,475 A 10/1999 Lawson et al.
6,000,754 A 12/1999 Lawson
6,231,120 B1 * 5/2001 Wiecek ..... 297/84
6,309,015 B1 * 10/2001 Pine ..... 297/85
6,733,071 B1 * 5/2004 Guillot et al. ..... 297/85

* cited by examiner

*Primary Examiner*—Milton Nelson, Jr.
(74) *Attorney, Agent, or Firm*—Dykema Gossett PLLC

(57) ABSTRACT

A support assembly for a rocker-recliner chair which includes a base assembly having rocker cams and a support assembly mounted to the rocker cams and which can be shifted between a retracted state, and intermediate extended state and a fully extended state, the support assembly including left and right linkage subassemblies that each include a rocker mounting link, a backrest mounting bracket, a main carrier link pivotally connected to a front portion of the backrest mounting bracket, a back push link pivotally connected to a rear portion of the backrest mounting bracket, a roller lock tube mounting link pivotally connected at a first end to a rear end of the rocker mounting link, a roller lock tube push link pivotally connected between the roller tube mounting link and the back push link, and a roller lock tube connected between second ends of the roller lock tube mounting links of both linkage subassemblies to rest upon the base beneath the backrest mounting bracket to prevent rocking of the support assembly when shifted out of its retracted state, to prevent lateral wandering of the rear ends of the linkage subassemblies and to provide firm support for the backrest mounting bracket thereabove.

14 Claims, 9 Drawing Sheets

4
4
7
7
5
5
80
80
10
110
54
15
91
17
16
18
19
20
11a
12a
11
100
12
97

SUPPORT MECHANISM FOR ROCKER-RECLINER CHAIR

BACKGROUND OF THE INVENTION

1. Field of the Invention

The present invention relates to support mechanisms for rocker-recliner chairs, and in particular to such support mechanisms which include rear blocking means for preventing rocking when shifted out of a retracted state and into an intermediate or fully extended state.

2. The Prior Art

Support mechanisms for rocker-recliner chairs are well known and generally include a base which is positionable on a flooring surface, left and right rocker cams positioned on the base, and a support assembly mounted on the rocker cams, the support assembly supporting the sides, backrest, seat and legrest of a chair and being shiftable between a retracted state, a partially extended state and a fully extended state to thereby enable the chair to convert between an upright condition, a partially reclined condition and a fully reclined condition. The support mechanism includes means to prevent rocking of its support assembly relative to the base when the support assembly is shifted out of its retracted state.

A support mechanism used in many rocker-recliner chairs currently available in the marketplace is disclosed in U.S. Pat. No. 6,000,754. This mechanism includes a rocker assembly mounted on rocker cams that are rockable on the rails of a base, the rocker assembly including recliner mechanisms at each side mounted on respective rocker cams, each recliner mechanism including a rocker blocker assembly that includes a link pivotally attached to the base and a landing roller which, when the associated rocker blocker assembly is articulated with the shifting of the rocker assembly out of a retracted state, will be lowered into contact with an associated rail of the base. The rollers, together with the associated link pivotally attached to the base, prevents rocking of the rocker assembly relative to the base.

However, if the rocker blocker assembly is constructed too tightly, such that its links cannot pivot freely relative to one another, the rocking of the rocker mechanism when in a retracted state will be inhibited. On the other hand, if the rocker blocker assembly is too loosely constructed, the rear portion of each recliner mechanism can laterally "wander," and if the wandering becomes too pronounced, the roller can fail to contact the intended landing area on the associated base rail. If the rollers should descend so as to miss the rail entirely, the support assembly will become racked and possible failure of the entire support mechanism is likely. In addition, the backrest mounting brackets of the rocker mechanisms are not directly supported by the rollers and thus are only supported by the seat mounting brackets, whose rear end portions must be constructed to be wide and thick to withstand the stresses placed thereon by the sometimes forceful rearward pivoting of the backrest mounting brackets when an occupant of the chair applies strong backward force on the backrest to force the chair into its fully reclined condition.

The object of the present invention is to provide a support mechanism for a rocker recliner chair which will avoid the drawbacks noted above, including the wandering of the rear ends of the linkage subassemblies at each side of the support assembly and which will provide firm support for its backrest mounting bracket when the support assembly is in a partially or fully extended state while eliminating the need for an enlarged construction of the seat mounting brackets.

SUMMARY OF THE INVENTION

The inventive support mechanism includes a base assembly that includes a floor-contacting portion and left and right cam members that are rockable on the floor-engaging portion, and a support assembly mounted on the base assembly, the support assembly including left and right linkage subassemblies which each includes a rocker mounting link having front and rear ends, a backrest mounting bracket for supporting a backrest of a chair, a main carrier link pivotally connected to a front portion of the backrest mounting bracket, a back push link pivotally connected to a rear portion of the backrest mounting bracket, a roller lock tube mounting link pivotally connected at a first end to the rear end of the rocker mounting link, and a roller lock tube push link pivotally connected between the roller tube mounting link and the back push link. A roller lock tube is connected between second ends of the roller lock tube mounting links of the left and right linkage subassemblies and is rotated downwardly onto the base assembly beneath the backrest mounting bracket to provide support to the backrest mounting bracket and prevent rocking of the support assembly when the support assembly is shifted out of it retracted state. The roller lock tube prevents lateral wandering of rear ends of the linkage subassemblies and provides reliable contact with the base assembly.

The invention will be better understood by reference to the attached drawings, taken in conjunction with the following discussion.

DETAILED DESCRIPTION OF THE PREFERRED EMBODIMENTS

Figure 12:
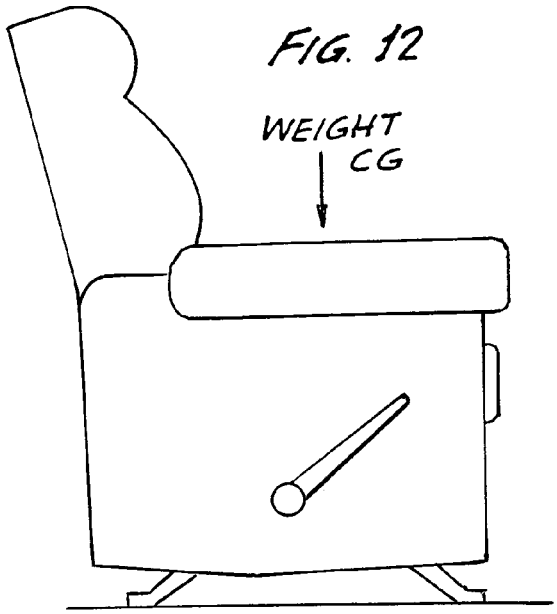
FIGS. 12–14 depict right side views of a rocker recliner chair containing the inventive support mechanism showing the approximate weight center of gravity when respectively in its upright, partially reclined, and fully reclined conditions.
Figure 13:
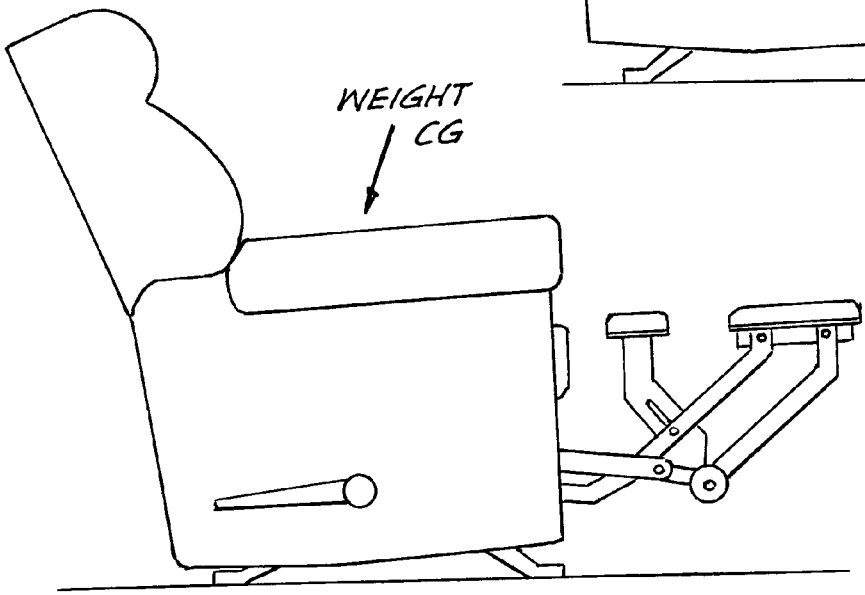
Figure 14:
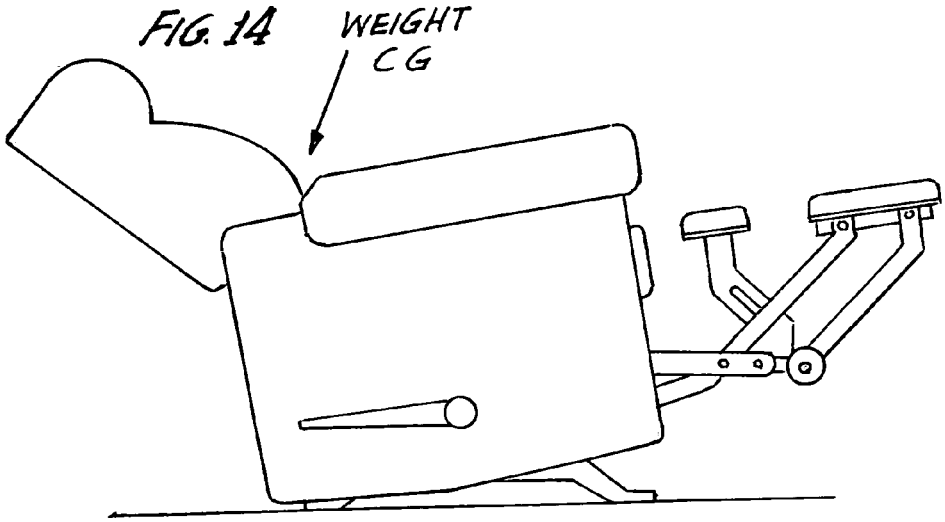

A preferred embodiment of a support mechanism for a rocker-recliner chair according to the present invention is shown in FIGS. 1–11, with a rocker-recliner chair which incorporates such a support mechanism being shown in FIGS. 12–14.

The support mechanism includes a base assembly 10 and a support assembly 30 which is mounted on the base assembly.

Figure 10:
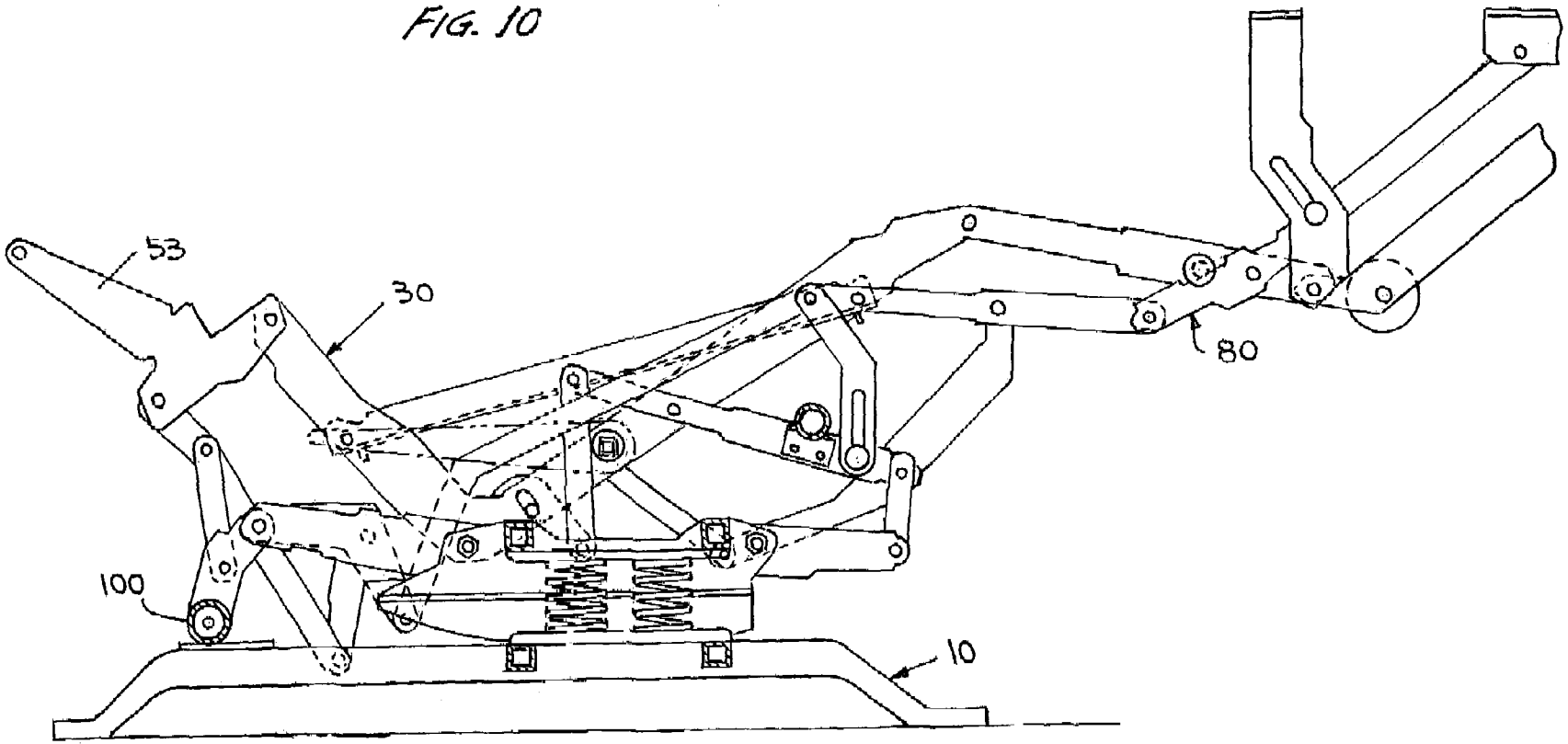
FIG. 10 is view similar to FIG. 4 when the support assembly has been fully extended (not able to rock)
Figure 11:
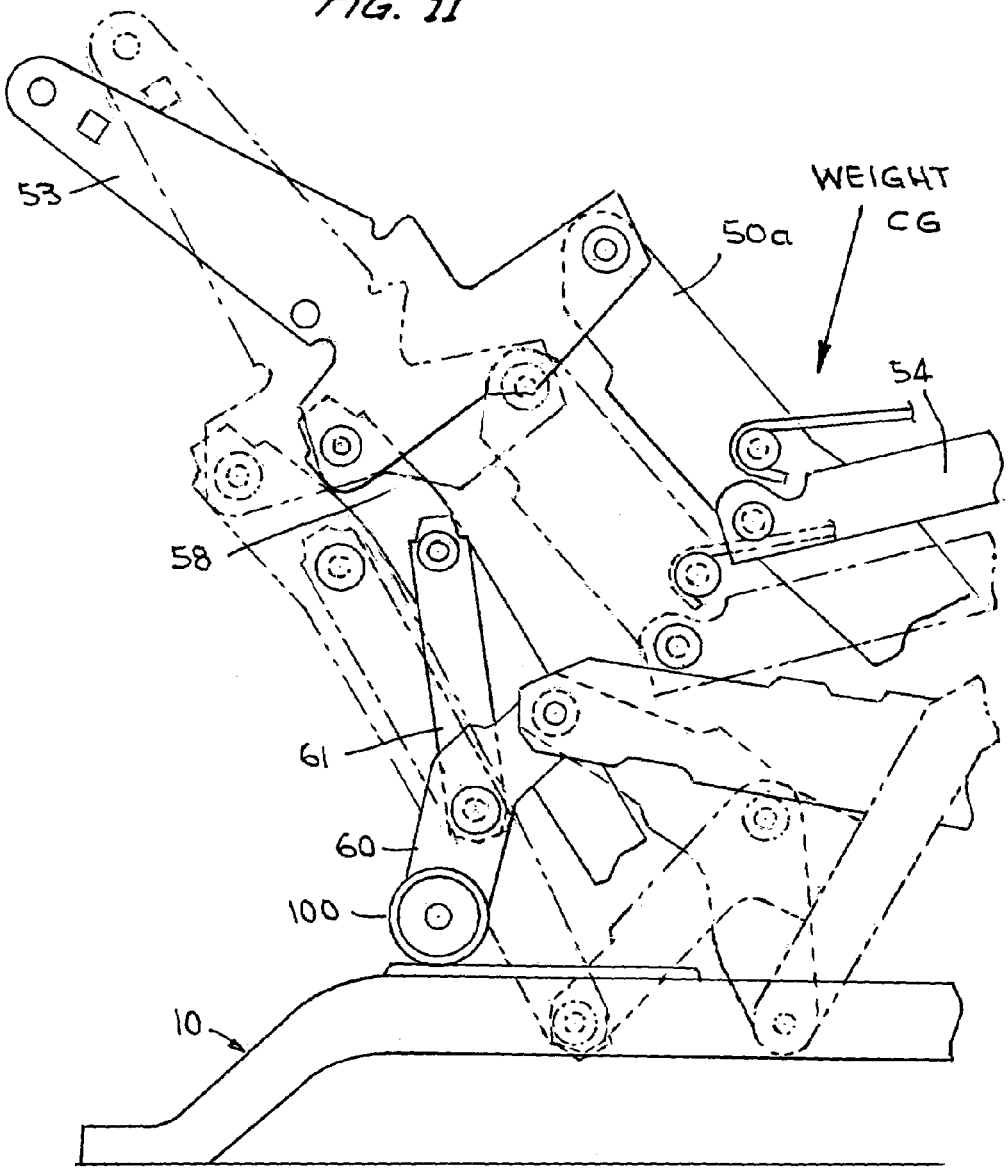
FIG. 11 shows a rear portion of the left linkage subassembly of the support mechanism when in a partially extended state (phantom lines) and in a fully extended state (solid lines)

The base assembly 10 includes left and right floor-contacting foot rails 11, 12 which are rigidly interconnected by front and rear cross rails 13, 14 (see FIG. 10). Left and right counter balancing spring assemblies 15, 16 are mounted between the cross rails 13, 14 and mount cross bars 17, 18 thereabove which extend in parallel with the cross rails 13, 14. The ends of the cross bars 17, 18 are connected to left and right cam flanges 19, 20 which have L-shaped cross sections and are respectively connected to the tops of left and right rocker cams 21, 22. The rocker cams are in rocking contact with the upper surfaces of the respective left and right foot rails 11, 12. The foot rails include respective landing pads 11*a*, 12*a* on their upper surfaces rearwardly of the cross bars for a purpose that will be referred to below.

The support assembly 30 includes left and right linkage subassemblies which are mirror images of one another and which are connected by a front stabilizer bar 110 and a round rocker (roller lock) tube 100. A handle tube 91 extends therebetween and rotation thereof by manual operation of a handle 97 causes the linkage subassemblies to operate and shift between retracted and intermediate-extended states.

Figure 1:
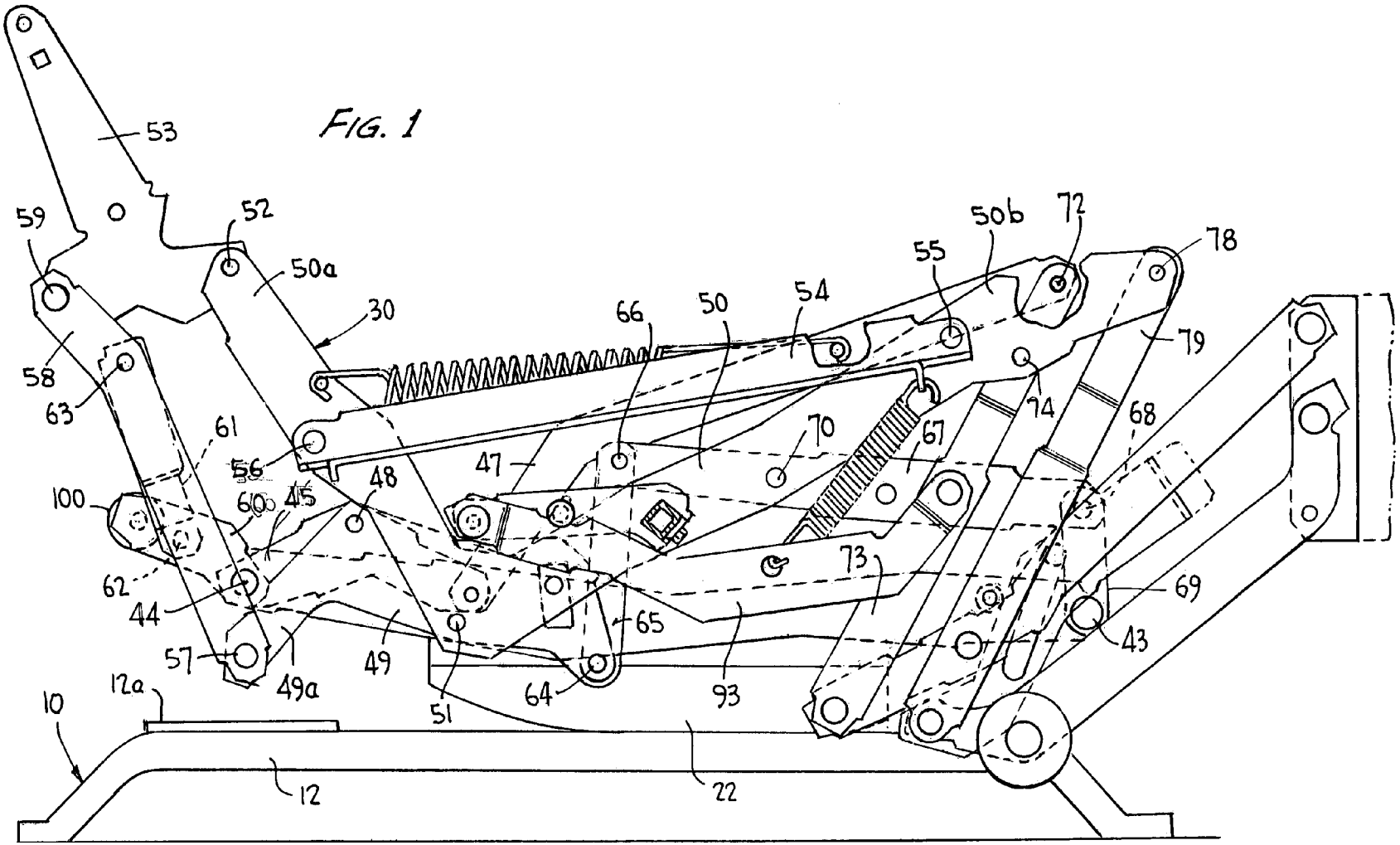
FIG. 1 shows a right side elevational view of a preferred embodiment of support mechanism for a rocker-recliner chair according to the present invention, the support mechanism including a support assembly mounted on a base assembly, the support assembly being depicted in a fully retracted state and free to rock.
Figure 2:
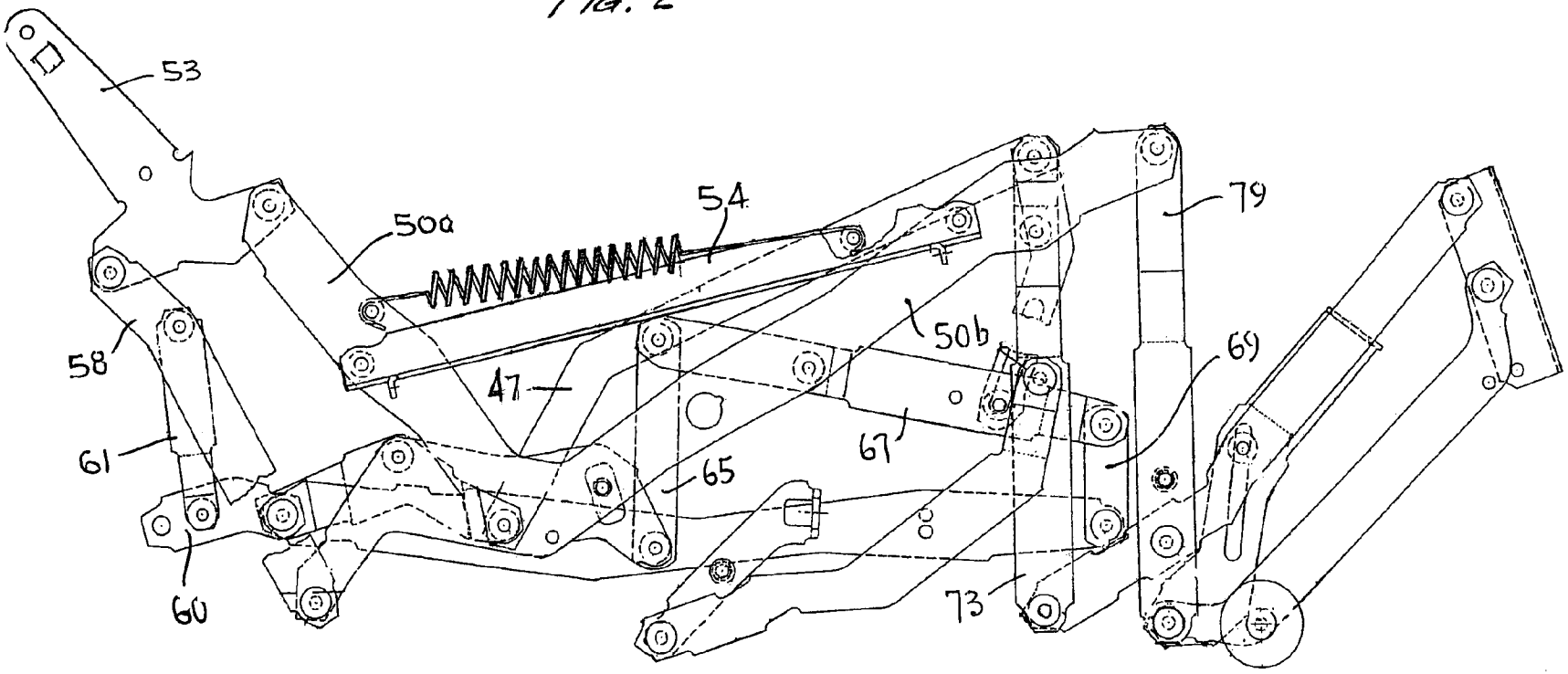
FIG. 2 is a view similar to FIG. 1 but wherein the support assembly has been partially shifted towards its intermediate extended state, its handle tube linkage being indicated as partially rotated downwardly.
Figure 3:
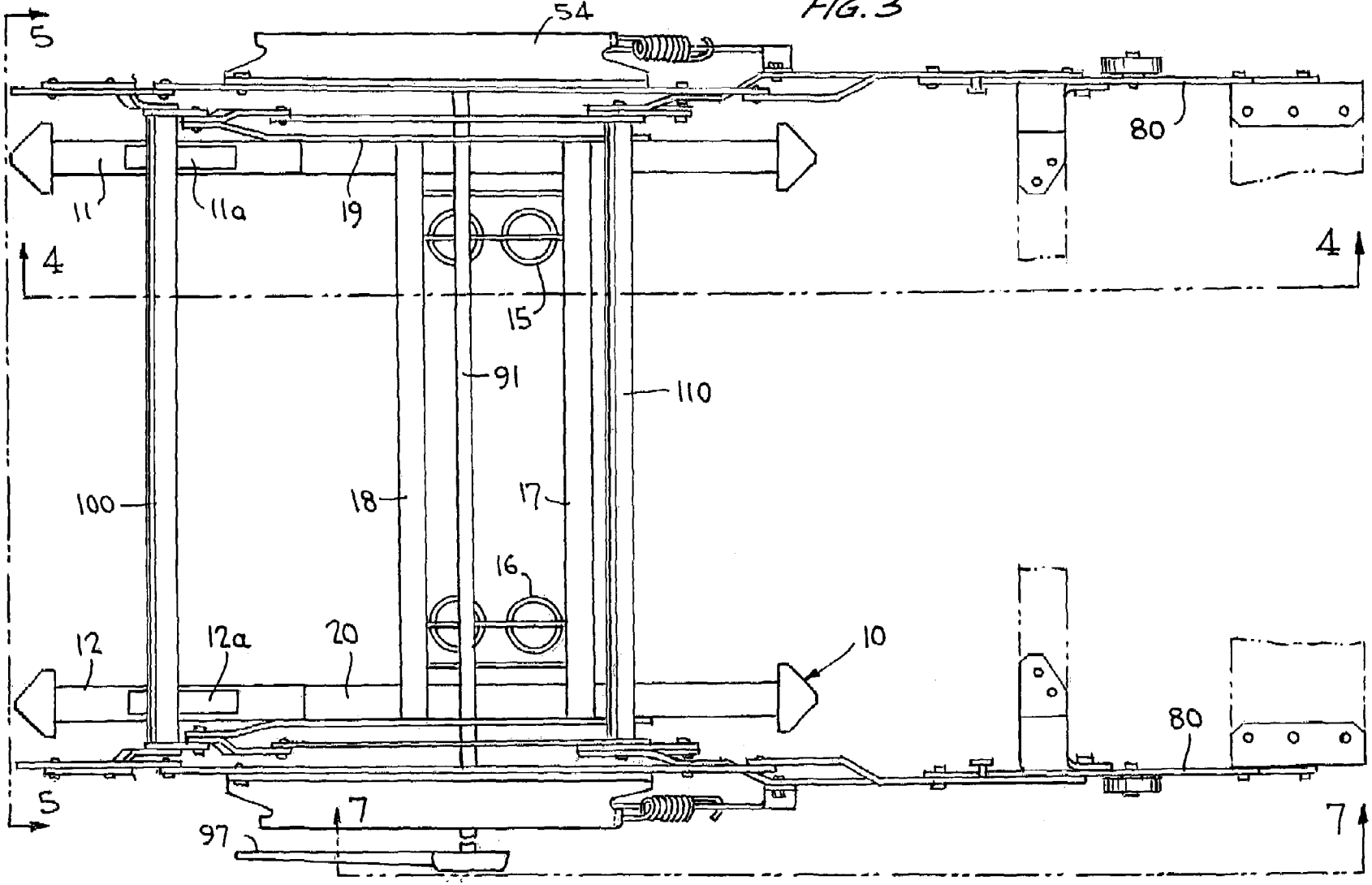
FIG. 3 is a top plan view of the support mechanism when its support assembly is in its intermediate extended state, the support assembly no longer being able to rock.
Figures 4, 5, 6:
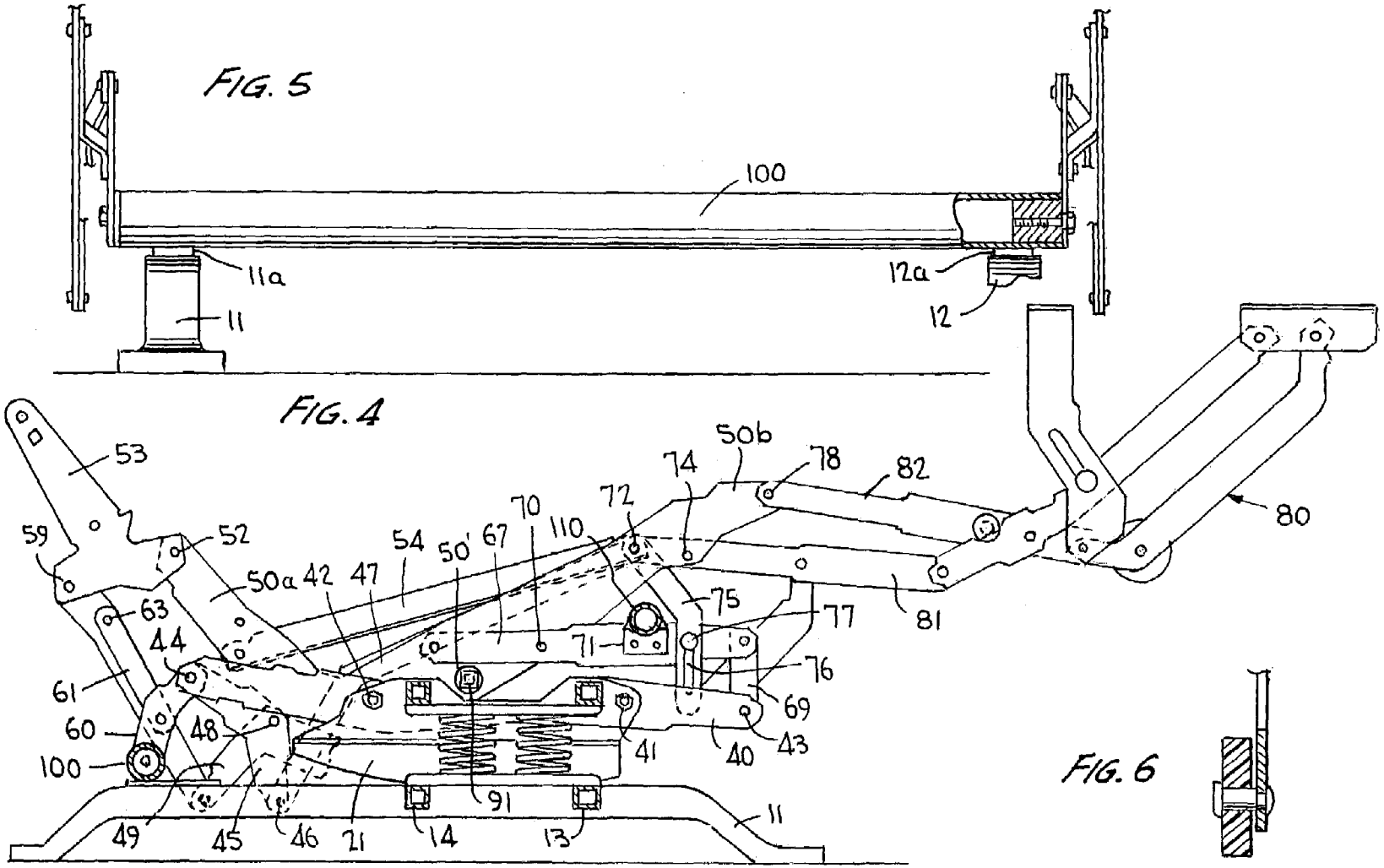
FIG. 4 is a cross sectional view of the support mechanism as seen along line 4—4 in FIG. 3.
FIG. 5 is a rear view of the support mechanism as seen along line 5—5 in FIG. 3.
FIG. 6 is a view of a part of FIG. 5 as seen along line 6—6 therein.
Figure 7:
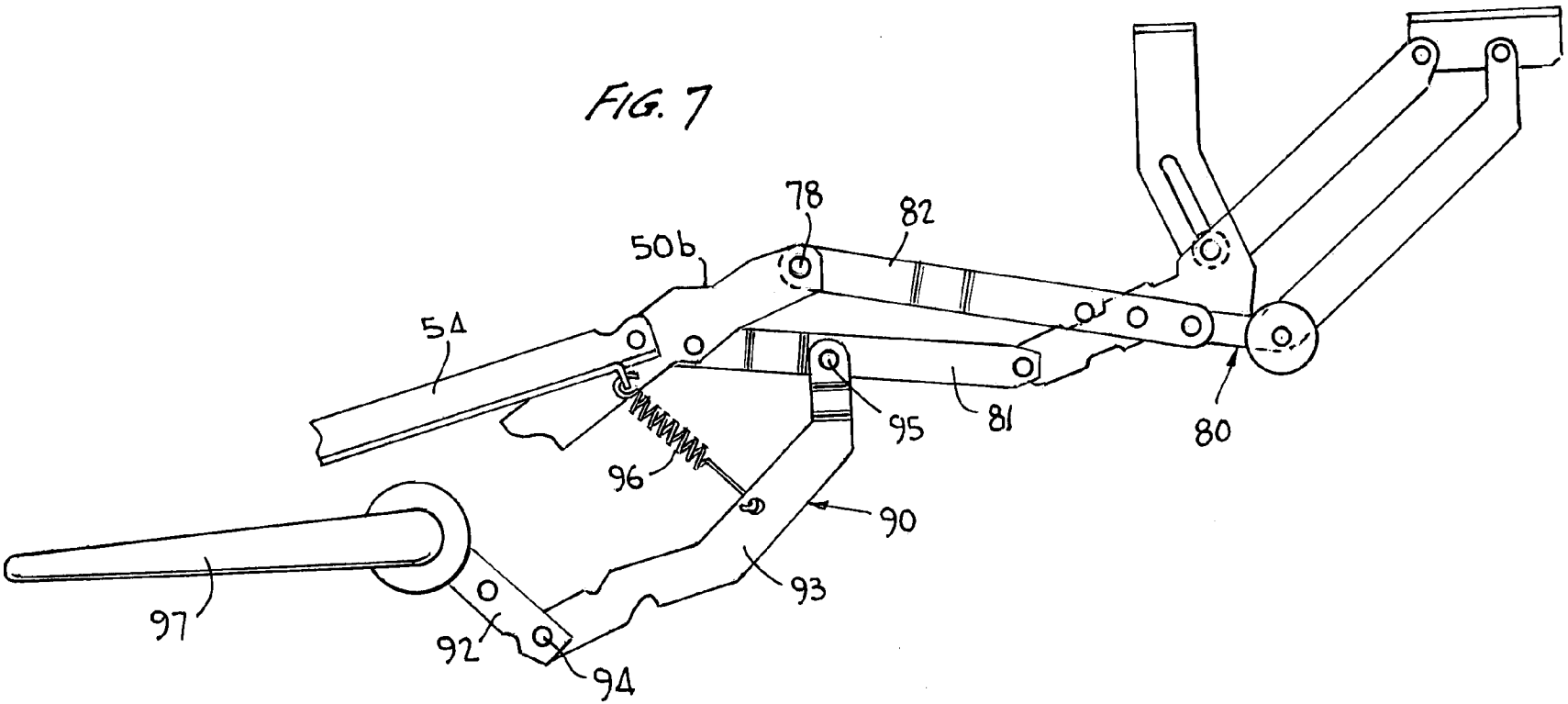
FIG. 7 is a partial view of FIG. 3 as seen along line 7—7 therein showing the handle tube linkage.
Figure 8:
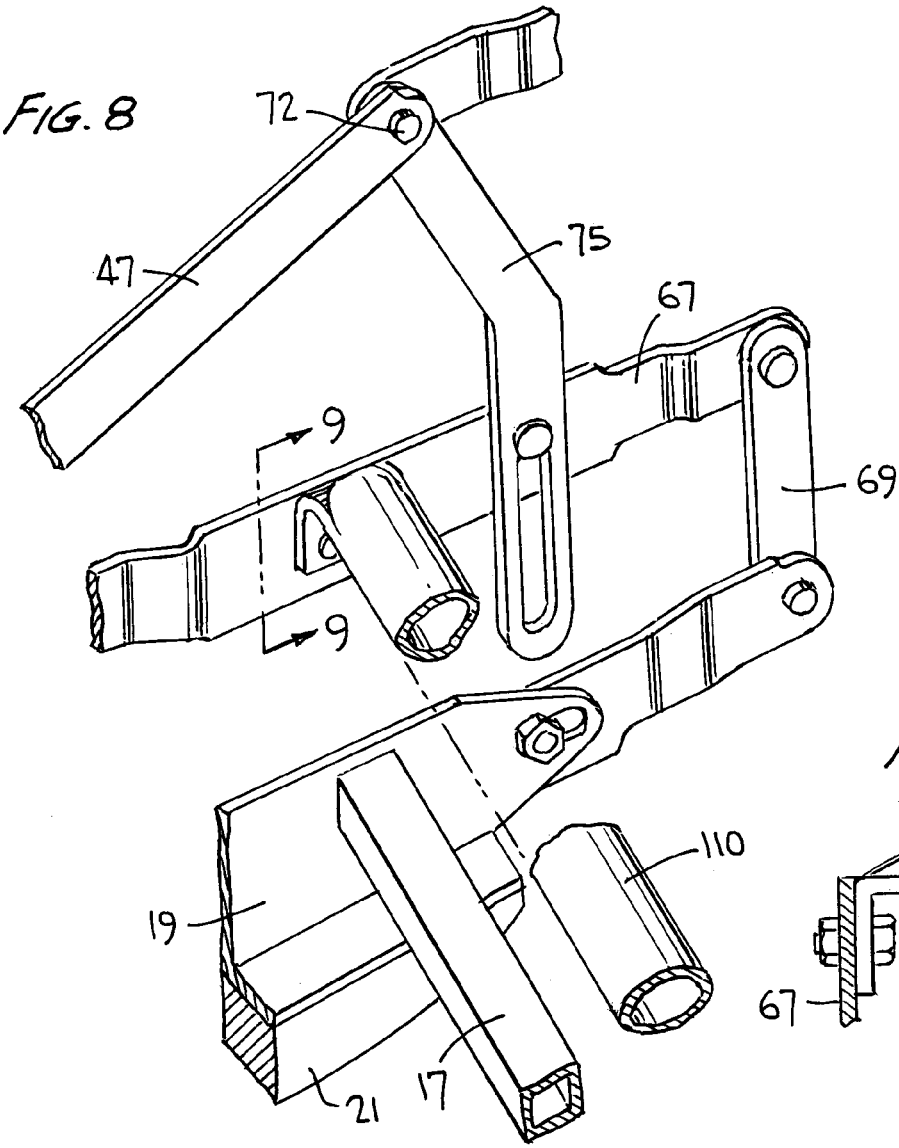
FIG. 8 is a perspective view of a portion of the support assembly of FIG. 4.
Figure 9:
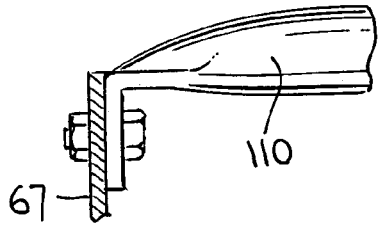
FIG. 9 is a view of FIG. 8 as seen along line 9—9 in FIG. 8.

Although FIGS. 1, 2 and 7 show the right linkage subassembly and FIGS. 4 and 10 show the left linkage subassembly, since the two linkage subassemblies are mirror images of one another, in the following discussion the elements of the linkage subassemblies will be described using a single numbering system.

Each linkage subassembly includes a rocker mounting link 40 which is attached to an adjacent cam flange of the base assembly 10 by front and rear bolts 41, 42 (see FIG. 4). The rocker mounting link mounts front and rear pivot pins 43, 44. One end of a rear drop link 45 is attached to the rear pivot pin 44, while its other end is attached to the rear end of ottoman pull ink 47 by pivot pin 46. A pivot pin 48 that extends through the rear drop link midway between pivot pins 44 and 46 connects to recline bellcrank 49, which in turn is pivotally connected to a generally V-shaped main carrier link 50 by pivot pin 51 (see FIG. 1). The main carrier link 50 includes a rear leg 50*a* and a front leg 50*b*. The rear leg 50*a* of the main carrier link 50 is attached to the front extension of backrest mounting bracket 53 at pivot pin 52. A seat mounting angle 54 is attached to and between legs 50*a* and 50*b* of the main carrier link 50 by rivets 55 and 56.

The downwardly-extending rear leg 49*a* of recline bellcrank 49 is connected to the lower end of back push link 58 by pivot pin 57. The upper end of the back push link 58 is pivotally attached to a rear extension of backrest mounting bracket 53 by pivot pin 59.

A roller tube mounting link 60 is pivotally attached at one end to the pivot pin 44 and its opposite end is connected to an end of roller lock tube 100. A lock tube push link 61 is pivotally connected to the rear drop link by pivot pin 62 and to the back push link 58 by pivot pin 63.

The front end of recline bellcrank 49 is attached to the lower end of recline connector link 65 by pivot pin 64. The upper end of the recline connector link 65 is pivotally attached to the rear end of front recline link 67 by pivot pin 66. The front end of front recline link 67 is pivotally attached to the upper end of recline idler link 69 by pivot pin 68. The front recline link 67 is pivotally attached to the front leg 50*b* of main carrier link 5Q by pivot pin 70. The lower end of the recline idler link 69 is pivotally attached to the pivot pin 43. The stabilizer bar 110 is connected to the front recline link 67 by bolts 71 (see FIGS. 4 and 8).

The front end of ottoman pull link 47 is pivotally connected to an end of first ottoman link 81 of an ottoman subassembly 80 by pivot pin 72. The first ottoman link 81 is pivotally connected to the front leg 50*b* of the main carrier link 50 at pivot pin 74. A sequencer link 75 having a slot 76 therein extends downwardly from the pivot pin 72. A sequencing pin 77 in the front recline link 67 extends within the slot 76. A second ottoman link 82 of the ottoman subassembly 80 is pivotally attached to a pivot pin 78 at the front end of leg 50*b* of the main carrier link 50.

The handle tube 91 extends through an opening 50' in the front leg 50*b* of the main carrier link. A handle tube link 92 is attached to the handle tube 91 to rotate therewith. An ottoman spring link 93 is pivotally connected to the handle tube link 92 at pivot pin 94 and it is connected to the first ottoman link 81 at pivot pin 95. A spring 96 extends between the ottoman spring link 93 and the front end of the seat mounting angle 54. A handle 97 is mountable on one end of the handle tube 91 to rotate it and thereby cause handle tube link 92 to rotate. The elements 91–97 are part of a handle tube linkage 90 for operating the support mechanism.

Manual rotation of the handle 97 when the support mechanism is in its retracted state (FIG. 1) will cause the ottoman spring link to rotate first ottoman link 81 upwardly about pivot pin 74, which will cause the rear end of the first ottoman link at pivot pin 72 to rotate downwardly, which in turn will cause ottoman pull link 47 to be moved downwardly and rearwardly. Due to the connection of the ottoman pull link 47 with the rear drop link 45 and is interconnection with all the other elements of the subassemblies, the support assembly will be shifted out of its fully retracted state (see FIG. 2) and lowered as it shifts into its intermediate extended state (see FIG. 4). During this lowering the roller lock tube 100 will be rotationally lowered onto the landing pads 11*a* and 12*a* of the base assembly 10. This will prevent rearward rocking of the support assembly relative to the base assembly. The location of the roller lock tube on the landing pads 11*a* and 12*a* will be directly beneath the backrest mounting bracket, and due to the lock tube push link 61, the backrest mounting bracket will be strongly supported above the base assembly 10 as shown in FIGS. 6 and 10.

Upon a rearward rotation of the back mounting link 53 (this will occur with an occupant of a chair in which the support mechanism is installed leaning strongly backwardly against an upper portion of the chair backrest), the back mounting bracket 53 of each linkage subassembly will rotate about the pivot pin 59 and, due to the interconnection of the other elements of the linkage subassemblies, shift the support assembly into it fully extended state (FIG. 10). The roller lock tube 100 will remain positioned directly beneath the back mounting bracket on the landing pads 11*a* and 12*a* and prevent rearward rocking.

The support assembly can be shifted back into it fully retracted state by an occupant leaning forwardly in the chair in which the support mechanism is installed and pressing downwardly on the ottoman subassembly 80 to shift it into it intermediate-extended state, and then rotating the handle 97 forwardly to shift the support assembly into its retracted state.

The interconnection of the roller lock tube 100 between the tube mounting links 60 of the left and right subassemblies prevents any possible lateral wandering of the rear ends of the left and right subassemblies and guarantees landing contact on the landing pads 11*a*, 12*a* of the base assembly 10. The positioning of the roller lock tube on the landing pads 11*a*, 12*a* beneath the backrest mounting brackets 53 of the two subassemblies and its direct support thereof provides stability to the support mechanism and eliminates the need for enlarged rear legs 50*b* of the main carrier links 50.

Although a preferred embodiment of this invention has been shown and described in detail, modifications therein can be made and still fall within the scope of the appended claims.

I claim:

1. A support mechanism for a rocker-recliner chair which comprises:

a base assembly that includes a floor-contacting base and a cam member which can rock forwardly and rearwardly on the base; and a support assembly mounted on the base assembly which can be shifted between a retracted state, an intermediate-extended state and a fully-extended state, said support assembly including left and right linkage subassemblies, a stabilizer bar connected between said linkage subassemblies and a roller lock tube connected between said linkage subassemblies; each linkage subassembly including a rocker mounting link connected to the base assembly, a backrest mounting bracket for supporting a backrest of a chair, a main carrier link having a front leg and a rear leg pivotally connected to a front portion of the backrest mounting bracket, a back push link pivotally connected to a rear portion of the backrest mounting bracket, a roller lock tube mounting link pivotally connected at a first end to a rear end of the rocker mounting link, and a roller lock tube push link pivotally connected between the roller lock tube mounting link and the back push link;

said roller lock tube being connected between second ends of the roller lock tube mounting links of the left and right linkage subassemblies, the roller lock tube being rotated downwardly onto the floor-contacting at a location beneath the backrest mounting bracket to provide support thereto and prevent rocking of said support assembly when the support assembly is shifted out of said retracted state, said roller lock tube preventing lateral wandering of rear ends of said subassemblies and reliable contact with the floor-contacting portion of the base assembly.

2. A support mechanism according to claim 1, wherein said floor-contacting base comprises left and right foot rails, and front and rear cross rails connected therebetween.

3. A support mechanism according to claim 2, wherein said base assembly includes left and right cam members respectively positioned on said left and right foot rails.

4. A support mechanism according to claim 3, wherein said base assembly includes counter balancing spring assemblies mounted on said front and rear cross rails, front and rear cross bars mounted on said counter balancing spring assemblies, and left and right cam brackets mounted at corresponding ends of said front and rear cross bars, said left and right cam brackets being attached to said left and right cam members and the rocker mounting links of said left and right linkage subassemblies being mounted on said left and right cam brackets.

5. A support mechanism according to claim 4, wherein said base assembly includes landing pads on upper surfaces of said left and right foot rails rearwardly of said front and rear cross bars, said roller lock tube contacting said landing pads when said support assembly is in said intermediate-extended and fully-extended states.

6. A support mechanism according to claim 1, wherein each linkage subassembly includes a rear drop link pivotally attached at one end to said rear end of the rocker mounting link, and a recline bellcrank located between said rear drop link and said main carrier link and pivotally attached thereto.

7. A support mechanism according to claim 6, wherein each linkage subassembly includes an ottoman pull link pivotally attached at a rear end: thereof to a front end of said rear drop link.

8. A support mechanism according to claim 7, wherein each linkage subassembly includes a recline connector link pivotally attached at a lower end to a front end of said recline bellcrank and at an upper end to a rear end of a front recline link, a front end of said front recline link being pivotally attached to an upper end of a recline idler link, and a lower end of said recline idler link being pivotally attached to a front end of said rocker mounting link.

9. A support assembly according to claim 8, including a handle tube assembly which includes a handle tube which extends between said right and left linkage subassemblies and a handle connected thereto, rotation of said handle causing said handle tube assembly to shift said support assembly between retracted and intermediate-extended states thereof.

10. A support assembly according to claim 9, wherein each linkage subassembly includes an ottoman subassembly which includes a first ottoman link connected to said ottoman pull link.

11. A support assembly according to claim 10, wherein each said ottoman subassembly includes a second ottoman link pivotally connected to a front end of said main carrier link.

12. A support assembly according to claim 11, wherein said main carrier link is generally V-shaped.

13. A support assembly according to claim 11, wherein said first ottoman link is pivotally connected to said front leg of said main carrier link.

14. A rocker-recliner chair which incorporates a support mechanism as defined in claim 1.

* * * * *